US011200801B1

(12) United States Patent
Wilkin

(10) Patent No.: US 11,200,801 B1
(45) Date of Patent: Dec. 14, 2021

(54) PREDICTIVE TRAFFIC LIGHT WARNING SYSTEM

(71) Applicant: Russell Wilkin, Henderson, NV (US)

(72) Inventor: Russell Wilkin, Henderson, NV (US)

( * ) Notice: Subject to any disclaimer, the term of this patent is extended or adjusted under 35 U.S.C. 154(b) by 0 days.

(21) Appl. No.: 17/095,281

(22) Filed: Nov. 11, 2020

(51) Int. Cl.
*G08G 1/096* (2006.01)
*G08G 1/095* (2006.01)

(52) U.S. Cl.
CPC ..... *G08G 1/096* (2013.01); *G08G 1/095* (2013.01)

(58) Field of Classification Search
None
See application file for complete search history.

(56) References Cited

U.S. PATENT DOCUMENTS 4,847,618 A * 7/1989 Baustin ..... G08G 1/096 340/929
4,908,616 A * 3/1990 Walker ..... G08G 1/096 340/916
6,597,293 B1 7/2003 Harrison
7,187,301 B2 3/2007 Lu
9,666,068 B2 * 5/2017 Fleming ..... E01F 9/559
2008/0071460 A1 * 3/2008 Lu ..... G08G 1/096758 701/93
2009/0135024 A1 * 5/2009 Park ..... G08G 1/096 340/929
2010/0117860 A1 5/2010 Agafonov

FOREIGN PATENT DOCUMENTS

WO 2008139470 11/2008

* cited by examiner

*Primary Examiner* — Brent Swarthout
(74) *Attorney, Agent, or Firm* — McAfee & Taft

(57) ABSTRACT

Methods and systems for providing advance warning of a change in status of a traffic light to drivers approaching an intersection. The systems and methods include secondary lights positioned in advance of a traffic light at an intersection so that they are visible to oncoming traffic; and using a controller to control the plurality of secondary lights to start flashing before the traffic light changes from green to yellow. Once activated, the lights flash in the direction of oncoming traffic to warn drivers approaching the intersection that a stop may be required and that caution should be exercised.

20 Claims, 3 Drawing Sheets

PREDICTIVE TRAFFIC LIGHT WARNING SYSTEM

FIELD

This disclosure relates in general to traffic control and traffic signal systems (traffic lights). More particularly, the present disclosure relates to various embodiments for advance traffic warning signals.

BACKGROUND

Traffic lights are a matter of public safety. Traffic accidents at intersections account for a vast majority of accident related injuries and fatalities each year, and as passenger and commercial traffic steadily increases, the coinciding risk of accident and injury also increases. Although we have seen great advances in technologies, traffic lights have largely remained unchanged since their conception and implementation.

Traffic lights control the flow of traffic at intersections by displaying visual indicators to approaching drivers about how to proceed through the intersection, i.e., continue driving or stop. An intersection is defined as a junction where two or more roads or streets meet or cross. Most urban intersections use traffic lights to ensure the safe and efficient flow of traffic. The most common traffic light display configuration is a series of three circular lights equally spaced in a vertical line or horizontal line: for example, a red light at the top, a yellow light in the middle located below the red light, and a green light at the bottom located below the yellow light. Some traffic lights also incorporate an arrow shaped light to control the flow of turning traffic, but this is sometimes also accomplished using a circular shaped light as well. Turning lights and main (flow-through) traffic lights typically have related but independent timing. The timing between the turning lights is coordinated for safety to ensure not all lights turn on the same colors at the same time. Multiple factors contribute to this timing variation including: the priority of the lane (higher volume traffic lanes typically get a higher priority), whether a car has been detected in the turning lane (if an inductive loop or other presence detection sensor is used), whether a pedestrian has activated the crosswalk signal, and whether any traffic is detected from other directions. If the main traffic light is green or yellow in one direction, then the traffic light controlling cross traffic (traffic approaching from the non-main direction) is red. Likewise, if a turning light has a green or yellow light illuminated, then all other traffic lights, which are controlling vehicles that might collide if allowed to proceed, are red. A green light indicates that the intersection is open and drivers are free to proceed through the intersection, a red light indicates that the intersection is temporarily closed in that direction and drivers should stop just before the intersection (prior to a stop line or demarcation line), and a yellow light typically provides a 3-6 second warning to drivers of an impending red light.

When a driver of a vehicle encounters one of these traffic lights they have to determine whether to continue driving through the intersection (green light), stop immediately (red light), or decide whether to continue or stop (yellow) depending on their vehicle's position relative to the intersection when the light changes from green to yellow. This latter transition tends to create the most significant safety risk, especially for semi-truck drivers and motorists pulling trailers or otherwise hauling heavy loads (heavy load motorists). The reason for this increased risk, is that these heavy load motorists create a significant amount of kinetic energy while traveling due to the increased mass they carry. Kinetic energy ($K_e$ expressed in joules) is explained by the equation $$K_e = \frac{1}{2}MV^2,$$

where M is mass (in kg) and V is velocity (or speed in m/s). Holding velocity constant and assuming the same acceleration and gravity acting on the mass, this equation explains that as mass increases more energy is created. Applying Newton's first law of motion to a typical vehicle stopping operation: in order for a vehicle to stop as designed, the vehicle's brakes have to create a counter energy equal to the kinetic energy generated by the vehicle. For example, a 40,000 pound (18,143.7 kg) truck (heavy load motorist) traveling at a given speed creates 10 times the energy of a 4,000 pound (1,814.37 kg) commuter car (light commuter) traveling at the same speed. When the traffic light changes from green to yellow for vehicles traveling along a roadway, a significant amount of braking energy to overcome the kinetic energy generated sufficient to cause the vehicles to stop before the intersection. Because kinetic energy increases exponentially ($V^2$) with respect to speed, drivers traveling at highway speeds 70 mph (39.2928 m/s) require significantly more stopping distance than do metro drivers traveling 45 mph (20.1168 m/s) (≅281.5% more energy is created). The risk of collision is more problematic when a heavy load motorist is following a typical commuter vehicle (light commuter) that stops quickly because of a traffic light transition. The light commuter can stop more quickly because it generates significantly less kinetic energy than heavy load motorists for the same speed due to having less mass. For example: according to the US Department of Transportation (USDOT), a truck driver carrying a fully loaded truck requires approximately 66% more stopping distance at 65 mph than does a car or small pickup truck traveling at that same speed. When the light commuter stops abruptly due to a traffic light changing, the heavy load motorist following them has to react quickly or risk a collision. When this occurs for the heavy load motorist, they often quickly engage their brakes causing their tires to lock up and skid. This is a dangerous situation for not only the heavy load motorist, but also for those in front of them because of the increased likelihood of collision.

Many traffic accidents also result from the inability of drivers to view the state of the traffic light, e.g., whether the traffic light indicates a red light or a green light, due to sun glare, poor visibility such as during a snow storm, or driver drowsiness. Drivers need a visible alert that is indicative of the state of the traffic light or, preferably, an advance visible warning of that state. Accordingly, there needs to be a better warning system to alert drivers of impending traffic light changes.

SUMMARY OF THE DISCLOSURE

Embodiments of the present disclosure include a method for providing advance warning of a change in status of a traffic light comprising: positioning a plurality of secondary lights at a roadway having an intersection with a traffic light so that they are visible to oncoming traffic, and optionally positioning the plurality of secondary lights in advance of, and optionally extending away from, the traffic light. In the method, a controller is used. The controller is configured to operate the plurality of secondary lights, wherein the controller causes the plurality of secondary lights to start flashing yellow before the traffic light changes from green to yellow, and optionally at least 3 seconds before the traffic light changes from green to yellow.

Other embodiments of the present disclosure include a predictive traffic light warning system, comprising a plurality of secondary lights positioned at a roadway having an intersection with a traffic light. The traffic light regulates traffic at an intersection by cycling through a green light, a yellow light and a red light. The plurality of secondary lights can optionally be in advance of the traffic light and/or extend away from the traffic light and the intersection. The system includes a controller configured to operate the plurality of secondary lights, wherein the controller causes the plurality of secondary lights to start flashing yellow before the traffic light cycles from the green light to the yellow light, and optionally at least 3 seconds before the traffic light cycles from the green light to the yellow light.

In the above embodiments, the plurality of secondary lights can be embedded in a surface of a roadway, wherein the surface and roadway are associated with the intersection. Further, the plurality of secondary lights can be positioned at least 20 yards in advance of the traffic light.

Also, the controller can be further configured to cause the plurality of secondary lights to start flashing red before the light changes from yellow to red.

BRIEF DESCRIPTION OF THE DRAWINGS

The drawings included with this application illustrate one embodiment of the system described herein, which some of the other system embodiments, and method embodiments described herein refer to. The components of the drawings are not necessarily to scale, emphasis instead is placed upon clearly illustrating the principles of the present invention. The drawings should not be viewed as illustrating an exclusive embodiment of the method and system described herein. The subject matter disclosed is capable of considerable modifications, alterations, combinations, and equivalents in form and function, as will occur to those skilled in the art with the benefit of this disclosure.

DETAILED DESCRIPTION

Figure 1:
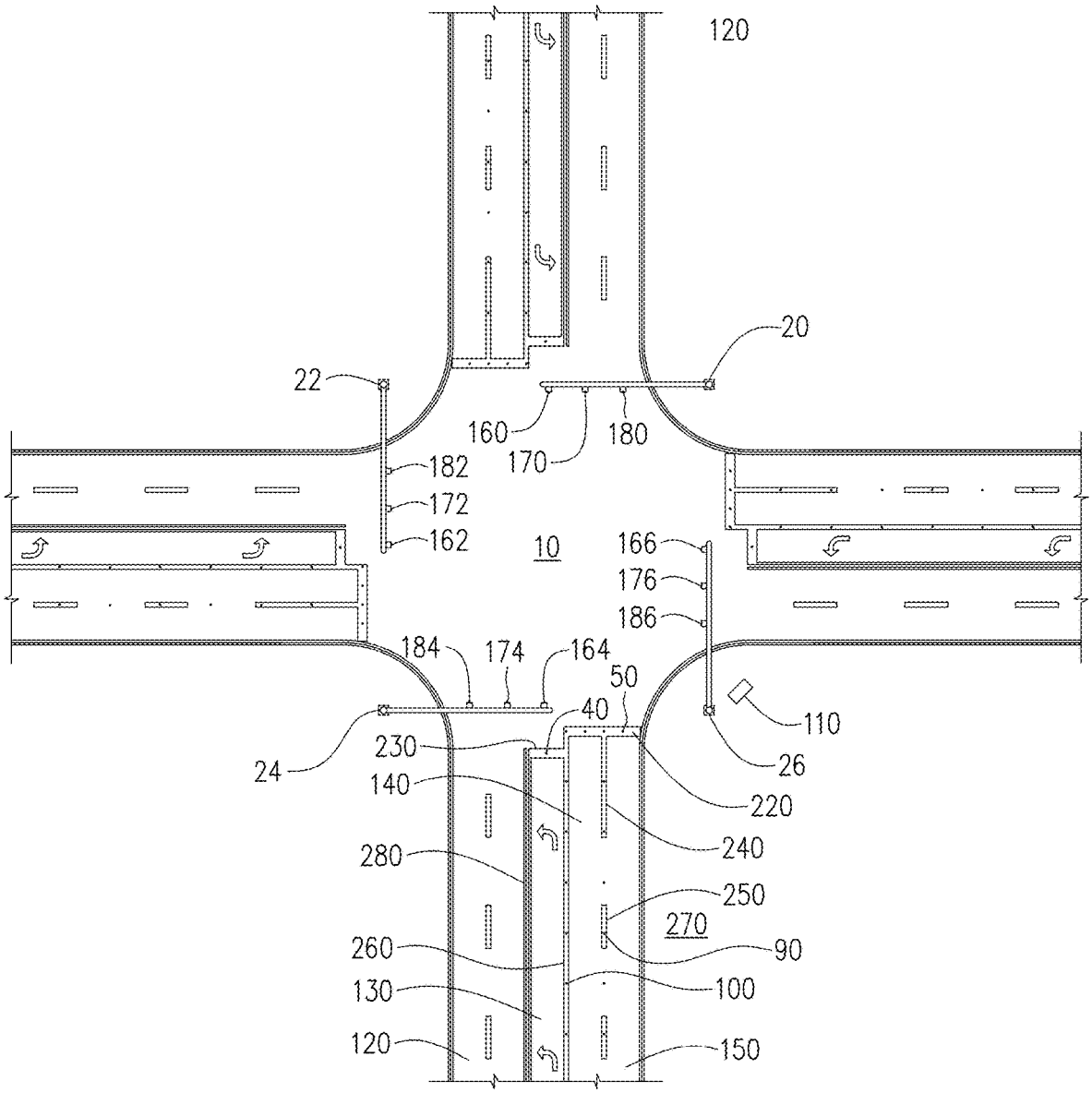
FIG. 1 is a top view of a four-way intersection and predictive traffic light warning system in one of its possible configurations.

The present disclosure may be understood more readily by reference to this detailed description. Numerous specific details are set forth in order to provide a thorough understanding of the various embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein.

As used herein and in the appended claims, a component that "comprises" or "includes" one or more specified parts means that the component includes the specified parts alone, or includes the specified parts together with one or more additional parts. A method "comprising" or "including" one or more specified steps or parts means that the method includes the specified steps or parts alone, or includes the specified steps or parts together with one or more additional steps or parts.

The present disclosure provides for systems and methods of predictive traffic light warning systems. The systems and methods use a plurality of secondary lights positioned at a roadway having an intersection with a traffic light. The plurality of secondary lights can be positioned on the same pole as the traffic light. Optionally, the secondary lights can be positioned on one or more separate poles located along the roadway in advance of the traffic light, or can be positioned in the roadway in advance of the traffic light. Further, the secondary lights can be positioned so as to extend along the road away from the traffic light and the intersection. Generally, a controller configured to operate the plurality of secondary lights. The controller causes the plurality of secondary lights to start flashing yellow before the traffic light cycles from the green light to the yellow light.

The use of the word "advance" as used herein, means "prior to" or "before." So, when a plurality of secondary lights is placed in advance of a traffic light, this means the plurality of secondary lights are placed in a position prior to the traffic light. Meaning, a driver approaching the intersection will likely see the plurality of secondary lights before seeing the traffic light. Likewise, when advance warning of an impending traffic light change is used, this means that the driver will see the warning from the plurality of secondary lights prior to the traffic light changing colors. Or the driver will be warned or notified before the traffic light changes colors. This does not mean the advance warning is limited to activating warning lights prior to (temporally) the traffic light change. Advance warning could also be accomplished by placing the warning lights at a position preceding the traffic lights and activating warning lights at substantially the same time as the traffic lights.

In this disclosure, statements about the lights flashing or the lights remaining on without flashing refer to perceivable flashes; that is alternating perceivable changes in light intensity. Persons having skill in the relevant art know that light intensity can be varied using methods such as pulse width modulation (PWM), which can be accomplished by flashing the lights so quickly that the flashing is undetected by an unaided observer. Using this method, the lights will be "on" for varying times depending on the intensity desired. For example, a 75% PWM corresponds to the light being "on" 75% of the time and "off" 25% of the time. Thus, the lights will appear to be on solid, when in fact they are flashing. Traditional incandescent light bulbs are an everyday example of a light flashing without detection by an unaided observer. Incandescent light bulbs flash about 120 times per second. When flashing or no longer flashing is used herein, it refers to flashing or lack of flashing that is perceived by unaided observers. So, although an incandescent light technically flashes while activated (or while it is "on") the light would not be considered flashing using this definition.

Turning now to FIG. 1, a top view of a four-way intersection and predictive traffic light warning system in one possible configuration is shown. The system is installed at or near an intersection 10. The intersection has four sets of traffic lights 20, 22, 24, 26 directing the flow of approaching traffic. Each set of traffic lights 20, 22, 24, 26 consists of three traffic light displays: a turning light 160, 162, 164, 166, and two main (flow-through) traffic lights [170, 180], [172, 182], [174, 184], [176, 186]. The use of the brackets around reference numbers is meant to indicate the items associated with the reference numbers operate in unison as a set. So, [170, 180] conveys the pair of traffic lights 170, 180 operate together. This does not mean to restrict the disclosure to only using pairs if brackets are used. For instance, brackets may be used for secondary lights in many of the disclosures, but each referenced secondary light set can be configured to operate independently.

As will be generally understood, the timing of traffic lights is coordinated among the different directions. Typically, the timing of a first set of flow-through traffic lights [170, 180] is in sync with opposing flow-through traffic lights [174, 184]. Further, the timing of flow-through traffic lights [170, 180] and [174, 184] are coordinated with their cross-direction counterparts, flow-through lights [172, 182] and [176, 186], so that the cross-direction counterparts are not green at the same time. (These sets were selected for convenience and not to imply priority.) For example: both traffic lights 170 and 180 within traffic light set 20 correspond to the flow-through traffic lights 174 and 184 within traffic light set 24; thus, when the [170, 180] pair turn on or off a set of lights, the [174, 184] pair will turn the corresponding (same color, but opposite direction) set of lights on and off at the same time. Further, flow-through lights [172, 182] and [176, 186] would be red when flow-through traffic lights [170, 180] and [174, 184] are green or yellow. There are exceptions, such as when there is a car in the turning lane on one side but not the other, or in the use of yellow-flashing left turn signals. These exceptions and variations will depend on unique setups and programming for each intersection and those skilled in the art will be readily able to adapt the methods and systems disclosed herein for such exceptions and variations based on this disclosure.

In the following sections, unless otherwise stated, numerical references will be made to only one direction of travel rather than naming corresponding items for each of the four directions. Namely, the direction of travel corresponding to traffic light set 20, turning lane 130, and flow-through traffic lanes 140 and 150 will be used. This includes the associated traffic lights 160, [170, 180], secondary lights 40, [50, 90, 100], demarcation lines 220, 230, and center lines 240, 250, 260. The same concepts will apply to all four directions of travel, and this use of one direction is meant to only reduce redundancy in writing.

The approaching traffic travels toward the intersection 10 using oncoming traffic lanes 140, 150, and drivers might choose to turn left at the intersection using the turning lane 130. Alternatively, the oncoming traffic might drive straight through using either the left flow-through lane 140, or the right flow-through lane 150. Traffic might also turn right using the right flow-through lane 150.

Intersection 10 uses a plurality of secondary lights 40, [50, 90, 100] to signal drivers that the traffic lights 160, [170, 180] are about to change. In this regard, intersection 10 has at least one, but generally a plurality, of secondary lights 40, 50 located at the intersection demarcation lines 230, 220, respectively. Additionally, a plurality of secondary lights [90, 100] extend away from the intersection 10 along the oncoming traffic lanes 140, 150. Although shown in advance of traffic lights 160, [170, 180], in some embodiments some or all of secondary lights can be located at the traffic lights, such as on the same pole as traffic lights 160, [170, 180].

Secondary lights 40 are located at the intersection demarcation line 220 for turning lane 130. Secondary lights 40 may be configured to change states based on the turning light 160. Thus, prior to turning light 160 cycling from green to yellow, secondary lights 40 would begin to flash to warn drivers of the pending change. Similarly, secondary lights 50 are located at the intersection demarcation line 220 for pass-through lanes 130, 140 and may be configured to change states based on the pass-through lights [170, 180]. Thus, prior to pass-through lights [170, 180] cycling from green to yellow, secondary lights 50 would begin to flash to warn drivers of the pending change. Also, secondary lights [90, 100] may be configured to change states based on pass-through lights [170, 180] so as to warn drivers of the impending change of pass-through lights [170, 180]. Generally, the secondary signal lights will provide advance warning of the change from green to yellow by starting flashing at least 3 seconds before the change, but can start flashing at least 4 or at least 5 seconds before the change. It is within the scope of this disclosure, for secondary signal lights 40, [50, 90, 100] to also provide advance warning for cycling from yellow to red, and/or from red to green. Often the advance warning for the change from yellow to red or from red to green will be at least 1 second before the change, or at least 2 seconds before the change or at least 3 seconds before the change. The user may choose this time or some other time by updating the settings or program in a controller. For instance, when snow and ice are present, the user may manually update the warning to 5 seconds to ensure even more notice to slow down. Alternatively, the system could incorporate sensors to detect the environment and update various settings real-time and automatically based on the weather at that location.

The method and systems herein can use ambient light sensors to set the intensity of the plurality of secondary lights 40, [50, 90, 100]. For instance, during the day the intensity of the lights might need to be much brighter than at night when it is dark. Also, for certain areas lacking supplemental lighting, i.e. street lights, the intensity at night may need to be reduced so that they do not interfere with drivers' ability to perceive the traffic lights [170, 180] or do not distract drivers, blur their view, or otherwise obstruct their view due to the intensity of a plurality of main secondary lights 40, 50 and/or alternate secondary lights [90, 100].

The dimming or variation in light intensity can be accomplished by modifying the applied voltage magnitude; i.e., either reducing a DC voltage or reducing a peak voltage for an AC (sinusoidal) wave form. There are many techniques for varying the intensity and a person having ordinary skill in the art would appreciate and be able to adapt those to these embodiments without departing from the spirit of this disclosure.

As indicated above, secondary lights [90, 100] extend away from the intersection 10. The main secondary lights 90 are positioned to correspond to the central traffic lines 240, 250, and the alternate or optional secondary lights 100, are positioned to correspond to the inside lane center line 260. Both main and secondary lights, in this embodiment, share the same spacing between lights; this could be varied for both or only one set without departing from the spirit of this disclosure. As shown, the first sets of secondary lights at the intersection [40, 50] are embedded in the line at the beginning of the intersection demarcation lines 220, 230. The sequence of main secondary lights 90 extending away from the traffic light set 20 between the flow-through lanes 140, 150, are spaced equally and embedded in the roadway along the center lines 240, 250. Likewise, the sequence of alternate secondary lights 100 extending away from the traffic light set 20 between the central flow-through lane 140 and the turning lane 130 are embedded in the roadway along the center line 260.

There is a controller 110 that coordinates the timing of lights between the traffic lights 160, [170, 180] and the plurality of secondary lights 40, [50, 90, 100]. The controller 110 could also be configured to control less than all the plurality of secondary lights 40, [50, 90, 100], or there could be multiple controllers 110 that need to coordinate control with each other.

Existing traffic light controllers may lack sufficient additional outputs and independent control configuration over those outputs to accomplish advance warnings described herein. Programmable Logic Controllers (PLCs) might be used either as the primary controller or as an additional controller for the secondary lights. Other microprocessor-based controllers, either existing or designed, might be used as well. Also, this controller may be capable of remote monitoring or control, i.e., Supervisory Control and Data Acquisition (SCADA) or telematics.

Alternatively, time delayed relays can be used to provide adjustable warning for existing traffic light systems lacking adequate controls. A relay is recommended for each individual light (i.e., green, yellow, red for each traffic light). Alternatively, a single time delay relay can control pairs of lights that operate jointly, wherein the original signal or power wire for the light are the triggering signal for the relay as well as for the secondary lights. The secondary lights are immediately activated upon receiving the signal while the specific traffic light would be delayed by the amount set on the relay. The relay can use the original wire as the common and when it trips at the predetermined delay, the light turns on. This technique would require the lights to be coordinated to ensure the appropriate sequence is maintained and for safety.

One way to ensure proper coordination is to provide the same delay for all three (3) light colors in all directions. For example, if a five (5) second delay is selected, then all three (3) light colors in all directions would be offset or delayed by the same five (5) seconds. This means that they would operate in the same manner, sequence, and time as they always have, but have a 5 second delay (with the exception being an additional 5 seconds added to a driver's wait who activates an inductive loop or presence sensor). Also, for this method, instead of the plurality of secondary lights being activated upon receiving a signal, they could delay for whatever time the user desired. For example, to get a 3 second delay, the controller would delay activating the plurality of secondary lights for 2 seconds after receiving a triggering signal (5 seconds−2 seconds=3 seconds). For a 1 second delay, the controller would delay activating the plurality of secondary lights for 4 seconds after receiving a triggering signal (5 seconds−4 seconds=1 second). Delays other than 5 seconds can be used without departing from the spirit of this disclosure. Also, persons having ordinary skill in the art would recognize other delay methods that could be used to accomplish the same or similar functionality as a time delay relay.

Figure 2:
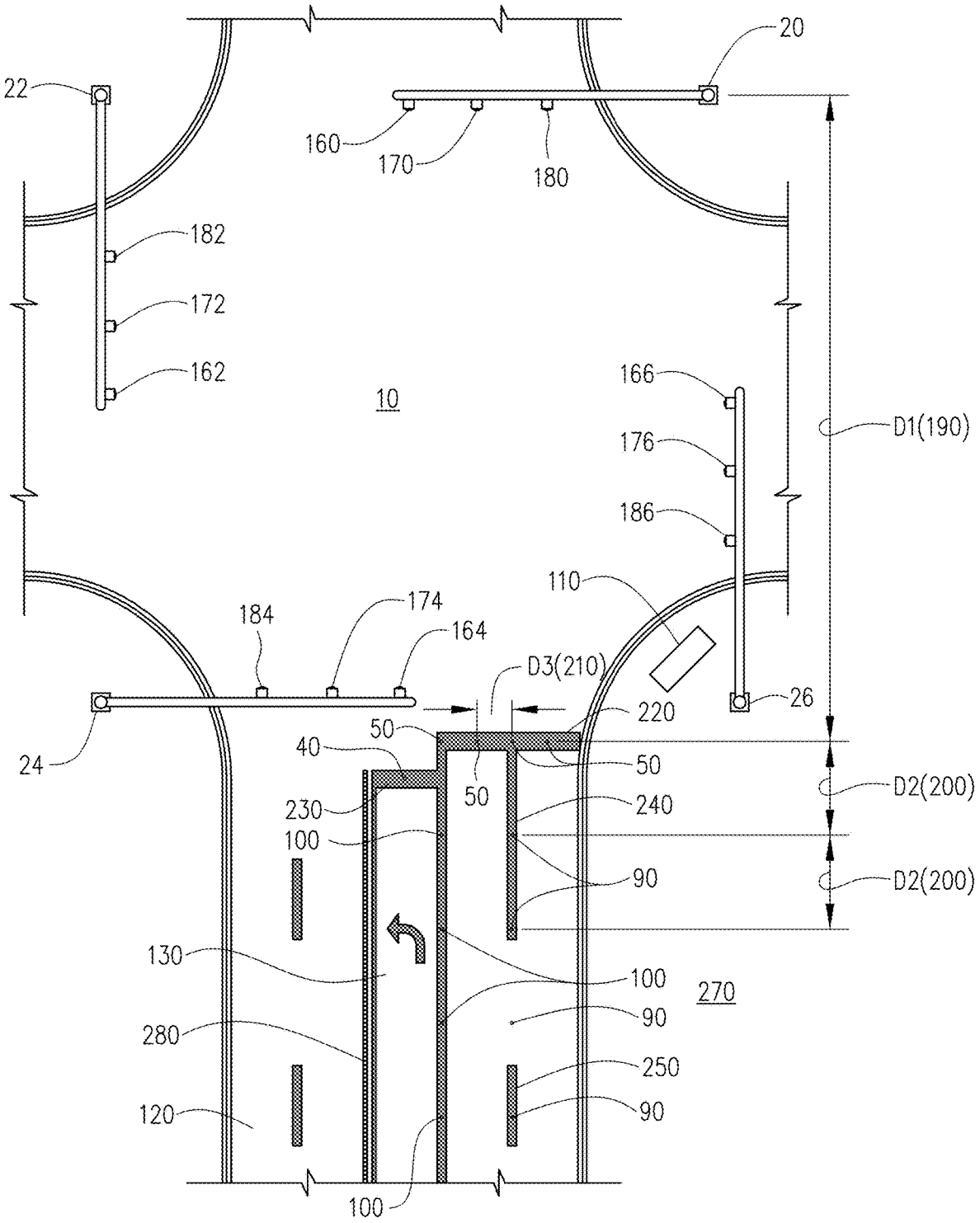
FIG. 2 is an enlarged top view of the intersection and predictive traffic light warning system of FIG. 1 to better illustrate the details for a single direction.

FIG. 2 is an enlarged top view of intersection 10 and the predictive traffic light warning system of FIG. 1 to better illustrate the details for a single direction. The distance D1 190 is the distance measured from the traffic light set 20 to the first secondary light (or set of lights) 50. Alternatively, D1 190 can be interpreted as the distance measured from the flow-through traffic lights [170, 180] to the first secondary light (or set of lights) 50. D2 200 is the subsequent outward spacing between secondary lights [90, 100]. D3 210 is the cross spacing between the first set of lights 40, 50.

Embodiments of the system and method comprise placing the plurality of secondary lights 40, [50, 90, 100] at least 20 yards in advance of the traffic light 160, [170, 180]. Meaning that D1 would be at least 20 yards in advance of the traffic light 160, [170, 180] and the following plurality of main and/or alternate secondary lights [90, 100] would extend even further based on D2. Many intersections position traffic light set 20 across the intersection from the lanes of traffic being controlled 130, 140, 150. If 12-foot wide lanes are used, then it is possible that the distance from the traffic light set 20 to the demarcation line 220 would exceed 20 yards. In this case, the user would either install the secondary signal lights 40, 50 on the demarcation lines 230, 220, or extend the installation distance for secondary lights 40, 50 prior to the demarcation line 220 away from the traffic light set 20, such as an additional 20 yards prior to demarcation line 220. This would help ensure drivers would see the plurality of secondary lights 40, [50, 90, 100] flashing with additional time to slow down before the intersection 10. The spacing D2 of subsequent plurality of secondary lights can be closer together than the initial spacing D1 from the first light 50 from the traffic light [170, 180]. For example, spacing D2 can be 10 to 15 yards between the plurality of main and/or alternate secondary lights [90, 100]. Other spacing may be used depending on speed, supplemental lighting, and traffic volume. For example, in some instances, users may want to increase the spacing D2 to spread the lights further apart because of a higher speed limit preceding the traffic light [170, 180] or when there is little or no supplemental lighting. Examples include a highway intersection in a rural area having little or no streetlights, or businesses around the intersection having significant lighting that may interfere with drivers' ability to perceive the traffic lights [170, 180] or plurality of secondary lights 40, [50, 90, 100]. Having a plurality of main and/or alternate secondary lights [90, 100] spaced D2 too closely may distract drivers, blur their view, or otherwise obstruct their view due to the intensity of plurality of main and/or alternate secondary lights [90, 100]. Likewise, if the lights [40, 50] are spaced too closely to D3 then, they could have the same effect. Generally, D3 can be from spaced from 3 to 12 feet apart.

Figure 3:
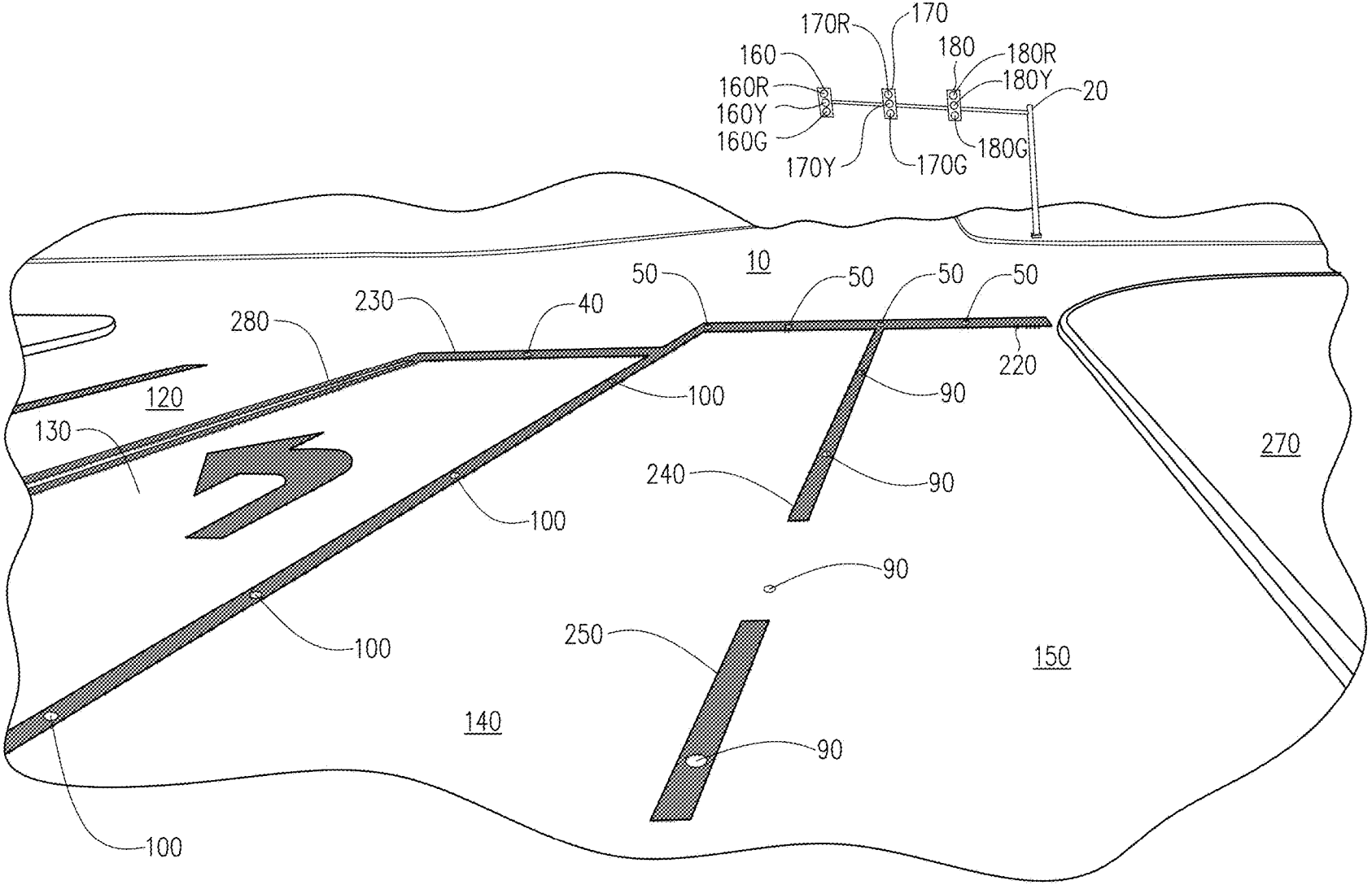
FIG. 3 is a perspective view from viewpoint of a driver approaching an intersection with a predictive traffic light warning system in one of its possible configurations.

FIG. 3 is a perspective view from viewpoint of a driver approaching intersection 10 with a predictive traffic light warning system in one of its possible configurations. Light 160 has a red light 160R, a yellow light 160Y, and a green light 160G. Light 170 has a red light 170R, a yellow light 170Y, and a green light 170G. Light 180 has a red light 180R, a yellow light 180Y, and a green light 180G.

As will be realized, some or all of secondary lights 40, 50, 90, 100 may be used depending on the circumstances. For example, main secondary lights 90 generally can be used without alternate secondary lights 100; however, in some circumstances, alternate secondary lights 100 alone may be more effective. For example, if an intersection is around a corner turning to the right, then using alternate secondary lights 100 may provide more notice or warning than would be using main secondary lights 90. A curvature to the right may conceal more of the main secondary lights 90 than would the use of alternate secondary lights 100 because of the relative location to the center of the road. Likewise, although not depicted, secondary light could also be placed along the right side of the roadway (or flow through lane 150) adjacent to the area alongside the roadway 270.

An intersection 10, such as that shown in FIG. 1, is a point where two or more roads meet, wherein that point is about where traffic is expected to flow-through. A traffic light 160, [170, 180], such as that shown in FIG. 3, uses standard colors: green light 160G, [170G, 180G], yellow light 160Y, [170Y, 180Y], and red light 160R, [170R, 180R]. Green light 160G, [170G, 180G] corresponds to an open intersection 10 and instructs the driver approaching to proceed through the intersection 10, red light 160R [170R, 180R] corresponds to a closed intersection 10 and instructs the driver approaching to stop prior to the intersection 10 (likely at or before the demarcation line 220, 230), and yellow light 160Y, [170Y, 180Y] corresponds to a temporary transition (usually 3-6 seconds) of the traffic light 160, [170, 180] from green light 160G, [170G, 180G] to red light 160R, [170R, 180R] thereby causing the driver to make a choice about whether to proceed through the intersection 10 or stop prior to entering the intersection 10. This choice is made based on the driver's speed and relative position to the intersection 10 when the traffic light 160, [170, 180] changes from green light 160G, [170G, 180G] to yellow light 160Y, [170Y, 180Y], and the driver's belief about which option is safer. Whether the intersection 10 is open or closed depends on which direction the driver is traveling, the driver's speed, and the status of the traffic light 160, [170, 180]. For example, stating that the intersection 10 is open or closed does not mean that it has to be closed in all directions; it merely means the access into the intersection is closed for the approaching traffic who receives a red light 160R [170R, 180R]. Many times, the intersection 10 will be open in one direction but closed in another.

As will be generally understood, traffic lights are configured to cycle through an orderly progression of colored lights. Referring to traffic light changes by colors corresponds to the signal indicators moving from one color (the first referenced) to the next color (the second referenced). The typical progression sequence for a traffic light is from green, to yellow, then to red. This sequence is a continuous loop, although the time spent on each color varies depending on the intersection location, what type of, and how many, sensors used, and other factors such as traffic volume and directional priority. The full cycle typically follows this order: green comes after red and before yellow, yellow comes after green and before red, red comes after yellow and before green. Accordingly, phrases such as the "changes to green" and "changes to the green light" are equivalent. Phrases such as "the traffic light changes from green to yellow", "the traffic light cycles from green to yellow, or similar refer to the traffic light [170, 180] turning the green light [170G, 180G] off and the yellow light [170Y, 180Y] on. Further, phrases such as "prior to changing from green to yellow", "before the light cycles from the green light to the yellow light", or similar mean any point in time after the referenced traffic light has turned on the green light but prior to the traffic light turning the green light off and the yellow light on. Further, the time of a traffic light changing color can be a mere instant or several seconds.

Also, lights are configured to prevent all traffic lights from displaying green or yellow at the same time. For example, assuming a two-directional traffic intersection: if there is a north-south flow of traffic that receives a green light, then the east-west traffic has a red light. Once the north-south traffic has received a red light, then after a short pause (typically 1-3 seconds), the east-west traffic will receive a green light. Each direction (east-west and north-south) progress through its full cycle or sequence before reaching red or green. This is merely a helpful definition to explain some features of the disclosure, but does not fully encompass every scenario for traffic light sequences. For example: a power cycle (or outage) may cause the lights in two or more directions to all flash red. Or, in one or more directions the light(s) flash red, while in other directions the flashing light(s) may be yellow. Or, when turning arrows are used, or if a particular intersection is complex, there may be a sequence from red to yellow without passing through green. The red to yellow sequence is typically reserved for turning lanes.

In accordance with the above, this disclosure provides for system and methods of providing advance warning to drivers approaching an intersection 10 of an impending traffic light [170, 180] change from green [170G, 180G] to yellow [170Y, 180Y]. Additionally, the system and method can provide advance warning to drivers approaching an intersection 10 of an impending traffic light 160 change from green 160G to yellow 160Y. Further, the system and method can provide advance warnings of changes of traffic lights [170, 180] from yellow [170Y, 180Y] to red [170R, 180R] and/or from red [170R, 180R] to green [170G, 180G], and/or provide for advance warnings of changes of traffic light 160 from yellow 160Y to red 160R and/or from red 160R to green 160G.

For example, embodiments of the system and method provide advance warning of the impending pass-through traffic light [170, 180] change and/or left-turn traffic light 160 change by placing a plurality of secondary lights 40, [50, 90, 100] in advance of pass-through traffic light [170, 180] and left-turn traffic light 160. A controller 110 to control the plurality of secondary lights [50, 90, 100] to flash prior to the traffic light [170, 180] changing from green [170G, 180G] to yellow [170Y, 180Y], and/or control secondary lights 40 to flash prior to traffic light 160 changing from green 160G to yellow 160Y. The controller can control the plurality of secondary lights 40, [50, 90, 100] or the traffic lights 160, [170, 180] and the secondary light 40, [50, 90, 100] so as to coordinate the timing so that oncoming traffic can view the plurality of secondary lights 40, [50, 90, 100] flashing prior to the traffic light 160, [170, 180] changing. Both the method and system can turn off the plurality of secondary lights 40, [50, 90, 100] when the traffic light 160, [170, 180] changes from yellow 160Y, [170Y, 180Y] to red 160R, [170R, 180R], but the plurality of secondary lights 40, [50, 90, 100] could also remain on, flash a new color, or change colors without flashing.

As described above, the plurality of secondary lights 40, [50, 90, 100] are embedded in the roadway, similar to how lights are installed at some crosswalks in school zones. FIGS. 1-3 show such a configuration. The lights should be placed deep enough to remain in place, but still be visible to oncoming traffic. This is particularly useful to provide a different vantage from the traffic lights to avoid sun glare, and if space is limited or if there are aesthetic concerns with placing a plurality of lighted poles (not shown) along a roadway 270. This configuration may also be more cost effective. However, other locations can be used for the secondary lights. For example, the secondary lights can be on the poles on which the traffic lights are mounted. As another example, one way to position the plurality of secondary lights in advance of and extending from the traffic light 160, [170, 180] is to use secondary poles or posts (not shown) to support the plurality of secondary lights 40, [50, 90, 100]. The secondary poles or posts (not shown) can be about the same height as other traffic sign poles or posts (not shown) and placed either in a center median area 280 of the roadway or alongside the roadway 270 so that drivers approaching the corresponding intersection can see the plurality of secondary lights 40, [50, 90, 100].

One way to control the plurality of secondary lights is to use a microprocessor-based controller 110. This controller 110 can also coordinate the sequence of lighting so that the plurality of secondary lights 40, [50, 90, 100] begin flashing prior to the traffic light 160, [170, 180] changing from green to yellow. A microprocessor-based controller 110 is not the only way to control and coordinate this sequence. For example, a series of digital logic flip-flops or other sequential logic circuits along with a 555 timer (or similar device or timing circuit) could be used to control and coordinate the timing and sequence of the plurality of secondary lights 40, [50, 90, 100].

One way to provide a coordinating signal, or connection, from the traffic light 160, [170, 180] or the traffic light controller (not shown) is to use a wireless connection to a monitoring device (not shown) connected directly to the traffic light 160, [170, 180] or the traffic light controller (not shown). One wireless protocol that might be used to accomplish this is Bluetooth. The monitoring device (not shown) can provide information to the controller 110 through the wireless connection about upcoming traffic light 160, [170, 180] changes. This information can be used by the controller 110 to schedule the plurality of secondary lights 40, [50, 90, 100] to begin flashing prior to the traffic light 160, [170, 180] changing from green to yellow.

Methods for wireless communications other than Bluetooth can also be used, and a person having skill in the relevant art would be capable of using another wireless protocol without departing from the spirit of this disclosure. A few examples of other wireless protocols that might be used are IEEE 802.11 or 802.15 (electromagnetic); IrDA specifications (optical); or SoniTalk ultrasonic (acoustic).

Of course, wireless connections have limitations, including: the potential loss of connectivity, security, data integrity, and speed. Therefore, a wired (or fiber optic) connection directly to the traffic light or traffic light controller could be used to provide a more reliable connection.

Another technique to coordinate the secondary light timing is to use an optical sensor (not shown), or a camera (not shown) used with imaging recognition software to detect changes in the traffic light. This would create a real-time extension of the traffic light 160, [170, 180]; meaning it would provide the flashing yellow plurality of secondary lights 40, [50, 90, 100] only when the yellow light 160Y, [170Y, 180Y] was activated on the traffic light 160, [170, 180]. Although the plurality of secondary lights 40, [50, 90, 100] would only flash at the same time as the traffic yellow light 160Y, [170Y, 180Y] is on, this technique would still provide advance warning because the plurality of secondary lights 40, [50, 90, 100] are positioned in advance of the traffic light 160, [170, 180] thereby alerting approaching drivers of a yellow light 160Y, [170Y, 180Y] at the intersection 10 sooner than without such warning because they could see the plurality of secondary lights 40, [50, 90, 100] prior to observing the traffic light 160, [170, 180].

The optical sensor (not shown) or camera (not shown) with image recognition software could also be positioned and connected to the controller 110 in such a way as to determine and transmit the timing of traffic light 160, [170, 180] changes. This may not be applicable for all traffic lights, but for some intersections this may be another option to provide warning. The sensor (not shown) or camera (not shown) would observe the changes in traffic light 160, [170, 180] colors and timing for those intersections whose control is based on only time. If the timing is consistent, then the controller 110 could adjust the timing to provide the desired advance warning. That adjusted timing and sequence could then be used by a controller 110 to control the plurality of secondary lights 40, [50, 90, 100]. For example, after monitoring the sequence the controller 110 could adjust the time so that the secondary lights are activated 3 seconds prior to the traffic light 160, [170, 180] changing from green 160G, [170G, 180G] to yellow 160Y, [170Y, 180Y]. This arrangement could continue to monitor the timing even after the initial setup to account for changes in timing and make timing adjustments as needed to provide the desired warning. Changes in the traffic light 160, [170, 180] timing can occur due to electrical component variation with temperature or municipality requirement changes. Alternatively, and as already discussed, time delay relays could be used to create a predictable pattern or sequence.

As indicated above, controller 110 generally will be configured to cause the plurality of secondary lights 40, [50, 90, 100] to flash yellow at least 3 seconds before the traffic light 160, [170, 180] changes from green 160G, [170G, 180G] to yellow 160Y, [170Y, 180Y]. Providing an additional 3 second warning should greatly reduce the number of potential accidents by allowing drivers more time to react and evaluate the environment. Typically, yellow lights are on for 3-6 seconds. By providing an additional 3 seconds prior to the traffic lights' change from green to yellow, drivers receive 50% or more notice prior to the traffic light changing to red.

Additionally, the controller 110 can be configured to cause the plurality of secondary lights 40, [50, 90, 100] to flash red at least 1 second before the traffic light 160, [170, 180] changes from yellow 160Y, [170Y, 180Y] to red 160R, [170R, 180R]; and to cause the plurality of secondary lights 40, [50, 90, 100] to flash green at substantially the same time as the traffic light 160, [170, 180] changes from red 160R, [170R, 180R] to green 160G, [170G, 180G].

Further, controller 110 can be configured to control the plurality of secondary lights 40, [50, 90, 100] to flash yellow at an increasing rate until reaching a steady on state at substantially the same time as the traffic light 160, [170, 180] turns the yellow light 160Y, [170Y, 180Y] on. This would provide drivers a way to better determine exactly when the traffic light 160, [170, 180] will change to yellow. For example, about 3 seconds (or some other defined time) prior to traffic light 160, [170, 180] changing to yellow 160Y, [170Y, 180Y], the plurality of secondary lights 40, [50, 90, 100] would begin flashing slowly. At about 2 seconds prior to the change to yellow, the plurality of secondary lights 40, [50, 90, 100] would begin flashing more quickly. When the traffic light 160, [170, 180] is a fraction of a second from changing to yellow, the plurality of secondary lights 40, [50, 90, 100] would flash very quickly, and about the instant the traffic light 160, [170, 180] changes to yellow the plurality of secondary lights 40, [50, 90, 100] would be turned on solid and no longer flashing. Typically, once the traffic light 160, [170, 180] changes from yellow 160Y, [170Y, 180Y] to red 160R, [170R, 180R], the plurality of secondary lights 40, [50, 90, 100] should be turned off. Alternatively, the plurality of secondary lights 40, [50, 90, 100] could turn red instead of being turned off.

A variation on the previous embodiment is for the controller to also be configured to cause the plurality of secondary lights 40, [50, 90, 100] to flash red at an increasing rate until reaching a steady on state at substantially the same time as the traffic light turns the red light on.

Another embodiment of this method and system, which will help ensure coordination between the traffic light 160,

[170, 180] and the secondary lighting system, is for the controller 110 to control both the traffic light 160, [170, 180] and the plurality of secondary lights 40, [50, 90, 100]. This method of control could be used with any or all of the above embodiments of the methods and systems. Additionally, the method and system of this disclosure may SCADA, internet of things (TOT) technology (not shown), or telematics or cellular connectivity technology (not shown) to allow the system status to be observed, and the configurations changed, online or through a network.

Therefore, the present method and system are well adapted to attain the ends and advantages mentioned, as well as those that are inherent therein. The particular examples disclosed above are illustrative only, because the present method and system may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered or modified, and all such variations are considered within the scope and spirit of the present method and system. Also, the terms in the claims have their plain, ordinary meaning unless otherwise explicitly and clearly defined by the patentee.

What is claimed is:

1. A predictive traffic light warning system, comprising:

a plurality of secondary lights positioned at a roadway having an intersection with a traffic light, wherein the traffic light regulates traffic at the intersection by cycling through a green light, a yellow light and a red light; and a controller configured to operate the plurality of secondary lights, wherein the controller causes the plurality of secondary lights to start flashing yellow before the traffic light cycles from the green light to the yellow light and causes the plurality of secondary lights to flash yellow at a progressively increasing frequency until the traffic light cycles from the green light to the yellow light.

2. The predictive traffic light warning system of claim 1, wherein the controller is further configured to cause the plurality of secondary lights to start flashing red before the traffic light cycles from the yellow light to the red light.

3. The predictive traffic light warning system of claim 2, wherein the plurality of secondary lights is located at least 20 yards in advance of the traffic light; at least a portion of the plurality of secondary lights extend away from the traffic light and the intersection, and wherein the controller is further configured to cause the plurality of secondary lights to start flashing green at substantially the same time as the traffic light cycles from the red light to the green light.

4. The predictive traffic light warning system of claim 3, further comprising a roadway having a surface, wherein the plurality of secondary lights is embedded in the surface of the roadway and wherein said plurality of secondary lights are in advance of the traffic light.

5. The predictive traffic light warning system of claim 4, wherein the controller is further configured to cause:

the plurality of secondary lights to start flashing yellow at least 3 seconds prior to the traffic light cycling from the green light to the yellow light; and the plurality of secondary lights to start flashing red at least 1 second prior to the traffic light cycling from the yellow light to the red light.

6. The predictive traffic light warning system of claim 5, wherein the controller is further configured to cause:

the plurality of secondary lights remains on and yellow without flashing when the traffic light cycles from the green light to the yellow light; and the plurality of secondary lights to flash red at a progressively increasing frequency until the traffic light cycles from the yellow light to the red light, at which time the plurality of secondary lights remains on and red without flashing.

7. A predictive traffic light warning system, comprising:

a plurality of secondary lights positioned at a roadway in advance of a traffic light, wherein the traffic light regulates traffic at an intersection by cycling through a green light, a yellow light and red light, and the plurality of secondary lights extend along the roadway away from the traffic light and the intersection; and a controller configured to operate the traffic light and the plurality of secondary lights, wherein the controller causes the plurality of secondary lights to start flashing yellow before the traffic light cycles from the green light to the yellow light and causes the plurality of secondary lights to flash yellow at a progressively increasing frequency until the traffic light cycles from the green light to the yellow light.

8. The predictive traffic light warning system of claim 7, wherein the controller is further configured to cause the plurality of secondary lights to start flashing red before the traffic light cycles from the yellow light to the red light.

9. The predictive traffic light warning system of claim 8, wherein the plurality of secondary lights is located at least 20 yards in advance of the traffic light; and wherein the controller is further configured to cause the plurality of secondary lights to start flashing green at substantially the same time as the traffic light cycles from the red light to the green light.

10. The predictive traffic light warning system of claim 9, further comprising the roadway having a surface, wherein the plurality of secondary lights is embedded in the surface of the roadway.

11. The predictive traffic light warning system of claim 10, wherein the controller is further configured to cause:

the plurality of secondary lights to start flashing yellow at least 3 seconds prior to the traffic light cycling from the green light to the yellow light; and the plurality of secondary lights to start flashing red at least 1 second prior to the traffic light cycling from the yellow light to the red light.

12. The predictive traffic light warning system of claim 11, wherein the controller is further configured to cause:

the plurality of secondary lights remains on yellow without flashing when the traffic light cycles from the green light to the yellow light; and the plurality of secondary lights to flash red at a progressively increasing frequency until the traffic light cycles from the yellow light to the red light, at which time the plurality of secondary lights remains on red without flashing.

13. A method for providing advance warning of a change in status of a traffic light comprising:

positioning a plurality of secondary lights at a roadway having an intersection with a traffic light at an intersection; and using a controller to control the plurality of secondary lights, wherein the controller causes the plurality of secondary lights to start flashing yellow before the traffic changes from green to yellow and wherein the controller is configured to cause the plurality of traffic lights to flash yellow at a progressively increasing frequency until the traffic light changes from green to yellow.

14. The method of claim 13, further comprising placing the plurality of secondary lights at least 20 yards in advance of and extending away from the traffic light.

15. The method of claim 14, further comprising embedding the plurality of secondary lights in a surface of the roadway.

16. The method of claim 15, further comprising configuring the controller to cause:

the plurality of secondary lights to flash yellow at least 3 seconds before the traffic light changes from green to yellow;

the plurality of secondary lights to flash red at least 1 second before the traffic light changes from yellow to red; and the plurality of secondary lights to flash green at substantially the same time that the traffic light changes from red to green.

17. The method of claim 16, further comprising:

placing at least three secondary lights equally spaced across a demarcation line, wherein the demarcation line indicates the beginning of the intersection; and placing at least 5 secondary lights equally spaced in a center line of the roadway.

18. The method of claim 17, further comprising, further configuring the controller to cause:

the plurality of secondary lights remains on yellow without flashing when the traffic light changes from green to yellow; and the plurality of secondary lights to flash red at a progressively increasing frequency until the traffic light changes from yellow to red, at which time the plurality of secondary lights remains on red without flashing.

19. The method of claim 17, further comprising configuring the controller to adjust the light intensity from the plurality of secondary lights based on ambient lighting.

20. The method of claim 19, further comprising configuring the controller to also control the traffic light.

* * * * *